US006845759B2

(12) United States Patent
Ohnishi et al.

(10) Patent No.: US 6,845,759 B2
(45) Date of Patent: Jan. 25, 2005

(54) LIQUID FUEL INJECTION SYSTEM

(75) Inventors: Takao Ohnishi, Nishibiwajima (JP); Toshikazu Hirota, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 96 days.

(21) Appl. No.: 10/293,242

(22) Filed: Nov. 13, 2002

(65) Prior Publication Data

US 2003/0094159 A1 May 22, 2003

(30) Foreign Application Priority Data

Nov. 16, 2001 (JP) ..... 2001-352166
Mar. 25, 2002 (JP) ..... 2002-083397

(51) Int. Cl.[7] ..... F02M 69/00
(52) U.S. Cl. ..... 123/478; 123/590; 239/102.2
(58) Field of Search ..... 123/472, 478, 123/490, 494, 498, 499, 470, 590, 90.15; 239/102.2, 583, 596, 585.1, 533.12

(56) References Cited

U.S. PATENT DOCUMENTS

| | | | | | |
|---|---|---|---|---|---|
| 4,550,703 | A | * | 11/1985 | Ootuka et al. | 123/478 |
| 4,576,136 | A | * | 3/1986 | Yamauchi et al. | 123/590 |
| 5,540,388 | A | * | 7/1996 | Sasao | 239/417.3 |
| 5,577,481 | A | * | 11/1996 | Wahba | 123/470 |
| 5,644,073 | A | * | 7/1997 | Matsuno et al. | 73/118.1 |
| 5,975,055 | A | * | 11/1999 | Matsuda et al. | 123/472 |
| 6,032,652 | A | * | 3/2000 | Nozawa et al. | 123/478 |
| 6,095,437 | A | | 8/2000 | Nozawa et al. | 239/408 |
| 6,474,566 | B1 | * | 11/2002 | Hirota et al. | 239/102.2 |
| 6,508,411 | B1 | * | 1/2003 | Ohnishi et al. | 239/4 |
| 2002/0050533 | A1 | * | 5/2002 | Hirota et al. | 239/102.2 |
| 2003/0071139 | A1 | * | 4/2003 | Ohnishi et al. | 239/102.2 |

FOREIGN PATENT DOCUMENTS

| | | | | |
|---|---|---|---|---|
| DE | 39 42 449 | | 7/1991 | |
| EP | 0 036 617 | | 9/1981 | |
| EP | 0 347 891 | | 12/1989 | |
| EP | 0 759 361 | | 2/1997 | |
| EP | 1 093 857 | | 4/2001 | |
| JP | 54-090416 | | 7/1979 | |
| JP | 5473 | * | 1/1993 | F02M/69/00 |
| JP | 06-040030 | | 2/1994 | |
| JP | 214302 | * | 7/2003 | F02M/69/00 |

OTHER PUBLICATIONS

Patent Abstracts of Japan, vol. 015, No. 232 (M–1124), Jun. 13, 1991 & JP 03 070863 A (Japan Electron Control Syst. Co. Ltd.), Mar. 26, 1991.

Patent Abstracts of Japan, vol. 1999, No. 09, Jul. 30, 1999 & JP 11 107890 A (Nippon Soken Inc; Denso Corp.), Apr. 20, 1999.

* cited by examiner

*Primary Examiner*—Hai Huynh
(74) *Attorney, Agent, or Firm*—Burr & Brown

(57) ABSTRACT

A liquid fuel injection system includes an injection unit for atomizing liquid through application to the fuel vibration energy induced by the operation of piezoelectric/electrostrictive elements, and a discharge valve for discharging pressurized fuel into the injection unit. Only during a period of time when an intake valve of an internal combustion engine is closed, an electric controller supplies a drive voltage signal of a certain frequency to the piezoelectric/electrostrictive elements of the injection unit so as to operate the piezoelectric/electrostrictive elements, and a valve-opening drive signal to the discharge valve so as to discharge fuel into the injection unit from a fuel path of the discharge valve.

5 Claims, 6 Drawing Sheets

LIQUID FUEL INJECTION SYSTEM

This application claims the benefit of Japanese Application Nos. 2001-352166 filed Nov. 16, 2001 and 2002-83397 filed Mar. 25, 2002, the entireties of which are incorpotated herein by reference.

BACKGROUND OF THE INVENTION

1. Field of the Invention

The present invention relates to a liquid fuel injection system for injecting atomized liquid fuel into a liquid injection space; specifically, an intake path of an internal combustion engine.

2. Description of the Related Art

Conventionally known liquid fuel injection systems include a fuel injection system for use in an internal combustion engine. The fuel injection system is a so-called electrically controlled fuel injection system, which is in wide use and includes a solenoid-operated injection valve and a pressure pump for pressurizing liquid fuel. In the electrically controlled fuel injection system, fuel is pressurized by means of the pressure pump and injected from an injection portion of the solenoid-operated injection valve. As a result, liquid droplets of injected fuel have a relatively large size of at least about 100 $\mu$m and are not of uniform size, whereby a large amount of fuel remains unburnt during combustion, leading to increased emission of undesirable exhaust gas.

Meanwhile, Japanese Patent Application Laid-Open (kokai) No. S54-90416 discloses a liquid droplet ejection system. In the liquid droplet ejection system, a piezoelectric/electrostrictive element is operated so as to pressurize liquid contained in a liquid feed path, thereby ejecting the liquid from an outlet in the form of fine droplets. Such a system utilizes the principle of an ink jet apparatus disclosed in, for example, Japanese Patent Application Laid-Open (kokai) No. H06-40030 and can eject finer liquid droplets (liquid droplets of fuel) of uniform size as compared with the above-mentioned electrically controlled fuel injection system, thereby realizing excellent liquid (fuel) atomization performance.

A liquid ejection system that utilizes the principle of an ink jet apparatus can eject fine liquid droplets as expected when used in a relatively steady atmosphere with little variation in temperature, pressure and the like (e.g., in an office, a classroom, or a like indoor space). However, the liquid ejection system usually fails to realize sufficient atomization performance when used under wildly fluctuating atmospheric conditions as found in the case of an internal combustion engine, which involves fluctuating operating conditions. Under the present circumstances, there has not been provided a liquid injection system that utilizes the principle of an ink jet apparatus and can inject sufficiently atomized liquid even when used in a mechanical apparatus involving wildly fluctuating atmospheric conditions as in the case of an internal combustion engine.

Additionally, even when sufficiently atomized liquid fuel is injected into the intake path of an internal combustion engine, if air flows at high velocity or turbulently in the intake path, liquid droplets of fuel collide and grow into larger droplets. The thus-grown liquid droplets may adhere to a wall or surface which forms the intake path (e.g., the wall surface of an intake port or a back surface of an intake valve); as a result, fuel may fail to be injected into a cylinder in a well-atomized condition.

SUMMARY OF THE INVENTION

In view of the foregoing, an object of the present invention is to provide a liquid fuel injection system capable of injecting liquid fuel in the form of droplets of small and uniform size, injecting liquid fuel in a stable atomization condition, and preventing adhesion of fuel to a wall or surface which forms an intake path.

To achieve the above object, the present invention provides a liquid fuel injection system comprising an injection device, a drive voltage generation device, a pressurizing unit for pressurizing liquid fuel, a discharge valve, and a valve-opening drive signal generation device. The injection device includes a liquid discharge nozzle having one end exposed to an intake path of an internal combustion engine, the intake path being equipped with an intake valve, a piezoelectric/electrostrictive element operated by means of a drive voltage signal, a chamber whose volume changes with operation of the piezoelectric/electrostrictive element and to which the other end of the liquid discharge nozzle is connected, a liquid feed path connected to the chamber, and a liquid inlet for establishing communication between the liquid feed path and an exterior of the injection device. The drive voltage generation device supplies the drive voltage signal to the piezoelectric/electrostrictive element. The discharge valve includes a liquid path, to which liquid fuel pressurized by means of the pressurizing unit is fed, and a solenoid-operated valve for opening and closing the liquid path in response to a valve-opening drive signal. The solenoid-operated valve is opened in response to receipt of the valve-opening drive signal in order to discharge liquid fuel, fed from the pressurizing unit, into the liquid inlet of the injection device via the liquid path. The valve-opening drive signal generation device issues (generates) the valve-opening drive signal to the solenoid-operated valve. Liquid fuel discharged from the discharge valve and injected into the intake path from the liquid discharge nozzle is atomized by means of variation in volume of the chamber. The valve-opening drive signal generation device issues (generates) the valve-opening drive signal only during a period of time when the intake valve is closed.

According to the above-mentioned configuration, liquid fuel pressurized by means of the pressurizing unit is discharged into the injection device from the discharge valve. Then, the liquid fuel is atomized by means of variation in volume of the chamber and injected into the intake path from the liquid discharge nozzle.

In this case, the size of liquid droplets of fuel formed through atomization depends on pressure applied to liquid fuel, the amplitude and frequency of vibration of the piezoelectric/electrostrictive element, the shape and dimensions of a flow path, physical properties such as viscosity and surface tension of liquid fuel, and other factors. However, when the period of vibration imposed on liquid fuel is shorter than the time required for liquid fuel to move by a length equivalent to the diameter of an end portion (an opening exposed to the intake path) of the liquid discharge nozzle in the vicinity of the end portion, the size of a liquid droplet of injected fuel becomes substantially not greater than the diameter of the end portion of the liquid discharge nozzle. Therefore, for example, through employment of a diameter not greater than several tens of micrometers for the end portion (opening) of the liquid discharge nozzle exposed to the intake path, the above-mentioned liquid injection system can inject liquid droplets of fuel in a uniformly and finely atomized condition. Thus, the liquid injection system can atomize liquid fuel into liquid droplets of a diameter appropriate for combustion in an internal combustion engine, thereby enhancing fuel economy of the internal combustion engine and reducing undesirable exhaust gas.

Also, according to the above-described configuration, pressure required to inject liquid fuel is generated by the pressurizing unit. Thus, even when atmospheric conditions (e.g., pressure and temperature) within the intake path, which is a liquid injection space, fluctuate wildly due to fluctuations in, for example, operating conditions of an internal combustion engine, the liquid fuel can be fed and injected stably in the form of fine droplets.

In a conventional carburetor, the flow rate of fuel (liquid) is determined according to air velocity within the intake path, and the degree of atomization depends on the air velocity. By contrast, the above-described liquid fuel injection system can inject fuel (liquid) by a predetermined amount in a well-atomized condition irrespective of air velocity. Further, in contrast to a conventional system in which assist air is fed to a nozzle portion of a fuel injector so as to facilitate fuel atomization, the liquid fuel injection system of the present invention does not necessarily require a compressor for feeding assist air, thereby reducing system cost.

According to the above-described configuration, the valve-opening drive signal is issued (generated) only during a period of time when the corresponding intake valve of the internal combustion engine is closed, whereby atomized fuel is injected only during a period of time when the intake valve is closed. Therefore, fuel is injected into a space with little flow or turbulence of air, to form well-misted pre-mixture in which atomized fuel is uniformly distributed in air. The thus-prepared pre-mixture is taken into a cylinder at a stroke when the intake valve is opened. As a result, liquid droplets of fuel hardly adhere to members which form the intake path, thereby enhancing fuel economy of the internal combustion engine and reducing undesirable exhaust gas. Further, even when liquid droplets of fuel adhere to the intake path and the periphery of an intake valve, the adhering liquid droplets readily evaporate, since they are very fine. Therefore, it can be avoided for the liquid fuel to drop into a cylinder. Thus, fuel economy of the internal combustion engine can be enhanced and undesirable exhaust gas can be reduced.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

Figure 1:
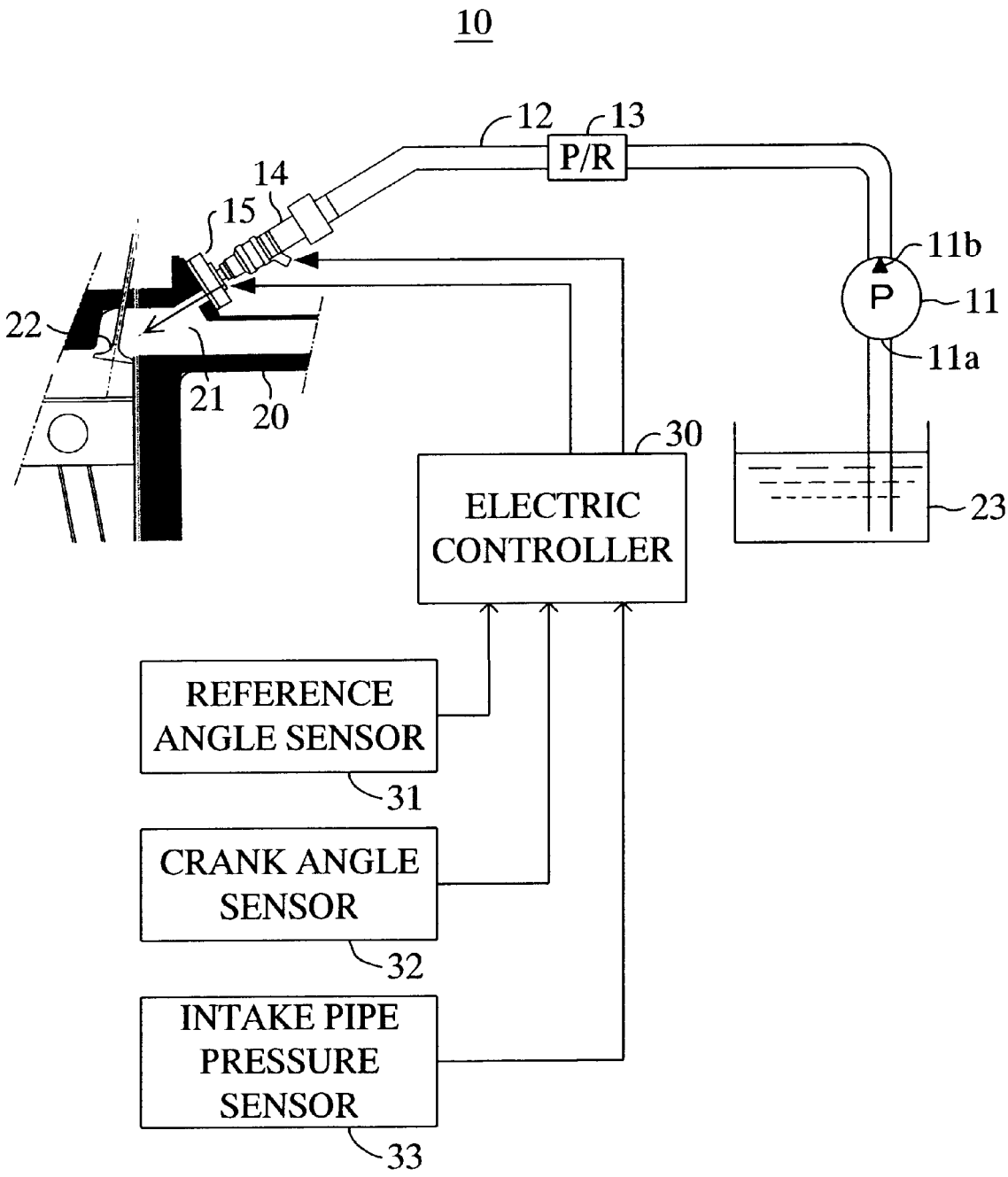
FIG. 1 is a schematic diagram showing a liquid fuel injection system according to an embodiment of the present invention which is applied to an internal combustion engine.

An embodiment of a liquid fuel injection system (a liquid injection system or a liquid droplet ejection system) according to the present invention will next be described with reference to the drawings. FIG. 1 schematically shows the configuration of the liquid fuel injection system applied to a multi-cylinder internal combustion engine which requires atomized liquid fuel. FIG. 1 shows merely the section of a single cylinder and its intake port, but the same configuration is applied to other cylinders and intake ports.

The liquid fuel injection system 10 of FIG. 1 is adapted to inject atomized liquid (liquid fuel such as gasoline; hereinafter may be called merely as "fuel") into an intake path 21—which serves as a fuel injection space and includes an intake port (or an intake pipe) 20 of each cylinder of an internal combustion engine—while directing the atomized liquid toward the back surface of an intake valve 22 of the internal combustion engine. The liquid fuel injection system 10 includes a pressure pump (a fuel pump) 11, which serves as a pressurizing unit; a liquid feed pipe (a fuel pipe) 12 in which the pressure pump 11 is installed; a pressure regulator 13 installed in the liquid feed pipe 12 on the discharge side of the pressure pump 11; a solenoid-operated discharge valve (hereinafter called merely as a "discharge valve") 14; an injection unit (an atomization unit) 15, which includes liquid discharge nozzles and chambers having respective piezoelectric/electrostrictive elements formed on their walls in order to atomize liquid to be injected into the intake path 21; and an electric controller 30 for supplying a valve-opening drive signal to the discharge valve 14 and a drive voltage signal for changing the volume of the chambers (for operating the piezoelectric/electrostrictive elements) to the injection unit 15.

The pressure pump 11 communicates with a bottom portion of a liquid storage tank (a fuel tank) 23 and includes a suction portion 11*a*, through which fuel is fed from the fuel tank 23, and a discharge portion 11*b* connected to the liquid feed pipe 12. The pressure pump 11 takes fuel therein from the fuel tank 23 through the suction portion 11*a* and pressurizes the fuel to at least a pressure (called a "pressure pump discharge pressure") capable of injecting the fuel into the intake path 21 via the pressure regulator 13, the discharge valve 14, and the injection unit 15 (even when the piezoelectric/electrostrictive elements of the injection unit 15 are inactive), whereby the pressurized fuel is discharged from the discharge portion 11*b* and then ejected (injected) into the liquid feed pipe 12.

The internal pressure of the intake path 21 is applied to the pressure regulator 13 through unillustrated piping. On the basis of the internal pressure of the intake path 21, the pressure regulator 13 reduces (or regulates) the pressure of fuel pressurized by the pressure pump 11 to a pressure (called a "regulated pressure") that is a predetermined pressure (a constant pressure) higher than the internal pressure of the intake path 21. As a result, when the discharge valve 14 is opened for a predetermined time, fuel is injected into the intake path 21 in an amount substantially proportional to the predetermined time, irrespective of the internal pressure of the intake path 21.

Figure 2:
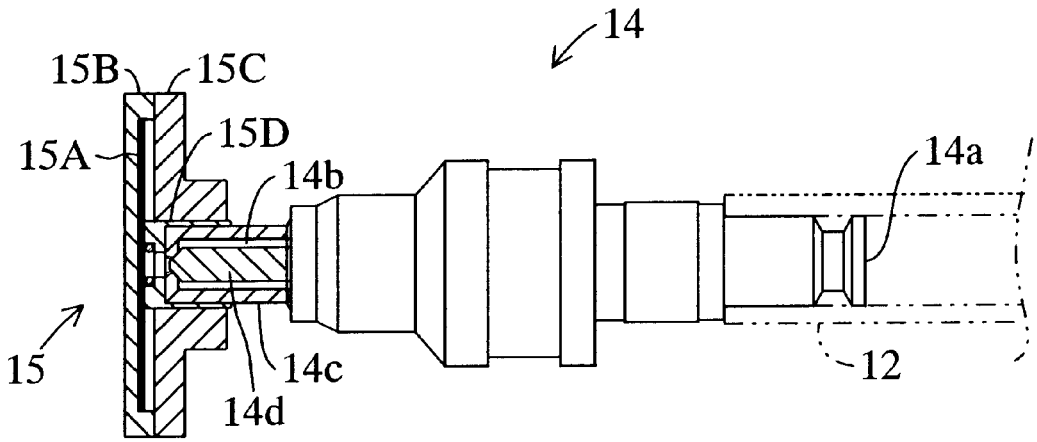
FIG. 2 is a view showing the discharge valve and the injection unit of the system of FIG. 1.

The discharge valve 14 is a known fuel injector (a solenoid-operated injection valve) which is widely employed in an electrically controlled fuel injection system of an internal combustion engine. FIG. 2 shows the discharge valve 14 while an end portion thereof is sectioned along a plane that includes the axis thereof, and the injection unit 15 which is also sectioned along the plane.

The discharge valve 14 includes a liquid inlet 14*a*, to which the liquid feed pipe 12 is connected; an external cylinder 14*c*, which defines a liquid path 14*b* communicating with the liquid inlet 14*a*; a needle valve 14*d*, which serves as the solenoid-operated valve; and an unillustrated solenoid mechanism for actuating the needle valve 14*d* upon reception of a valve-opening drive signal (a high-level signal). An end of the external cylinder 14*c* is closed. A conical valve seat—whose shape is substantially identical to that of an end portion of the needle valve 14*d*—is formed at a central portion of the closed end. A plurality of discharge holes (through-holes) are formed in the closed end in the vicinity of the valve seat so as to establish communication between the interior of the external cylinder 14*c* (i.e., the liquid path 14*b*) and the exterior of the external cylinder 14*c*. Thus, when the valve-opening drive signal, which is a high-level signal, is issued (generated, supplied) to the solenoid mechanism of the discharge valve 14, the needle valve 14*d* is actuated to thereby open the discharge holes (the liquid path 14*b* is opened). As a result, fuel fed to the liquid path 14*b* from the pressure pump 11 is discharged through the discharge holes.

The injection unit 15 includes an injection device 15A, an injection device fixation plate 15B, a retaining unit 15C for retaining the injection device fixation plate 15B, and a sleeve 15D abutting a leading end of the discharge valve 14.

Figure 3:
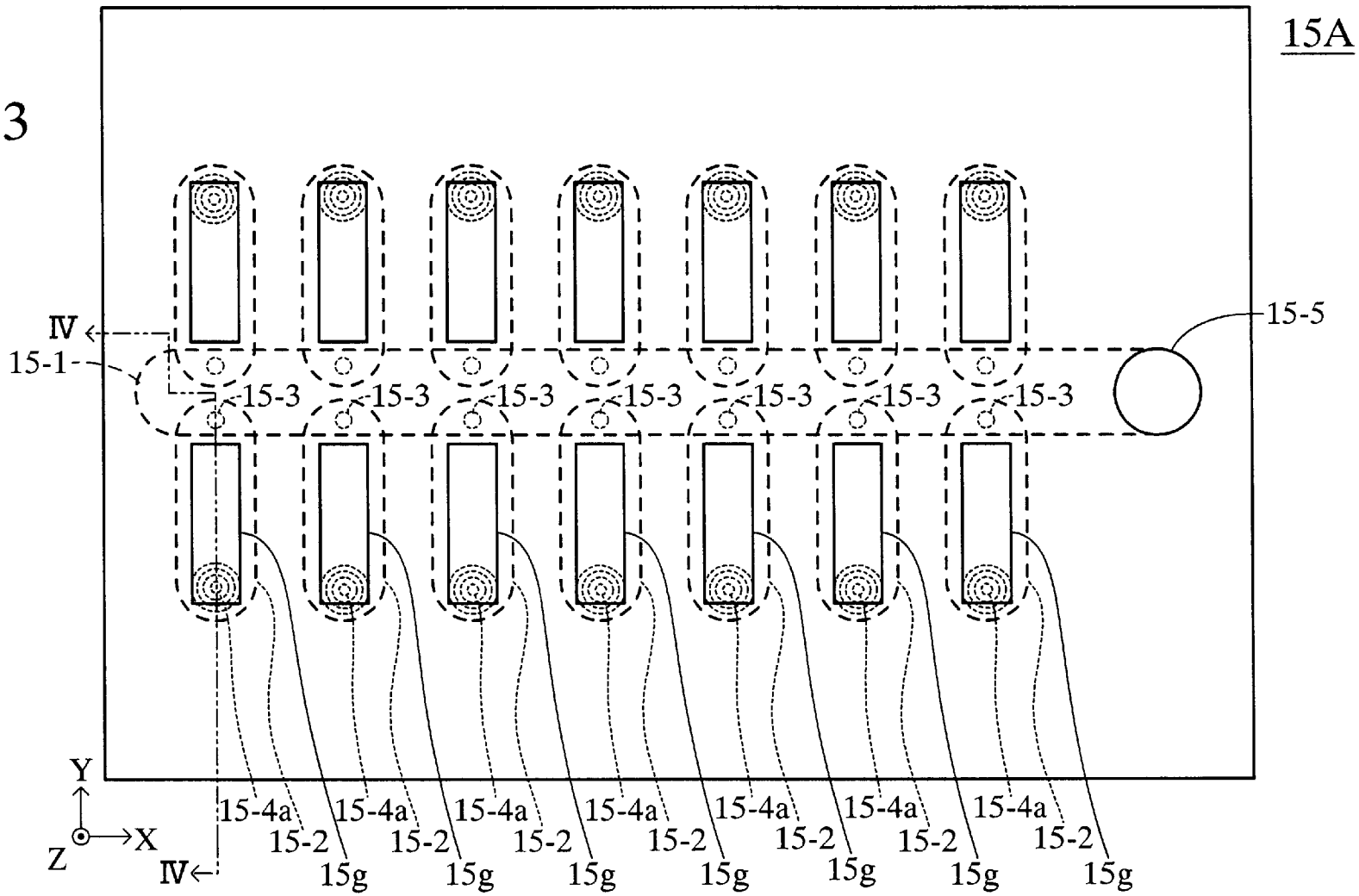
FIG. 3 is a plan view showing the injection device of FIG. 2.
Figure 4:
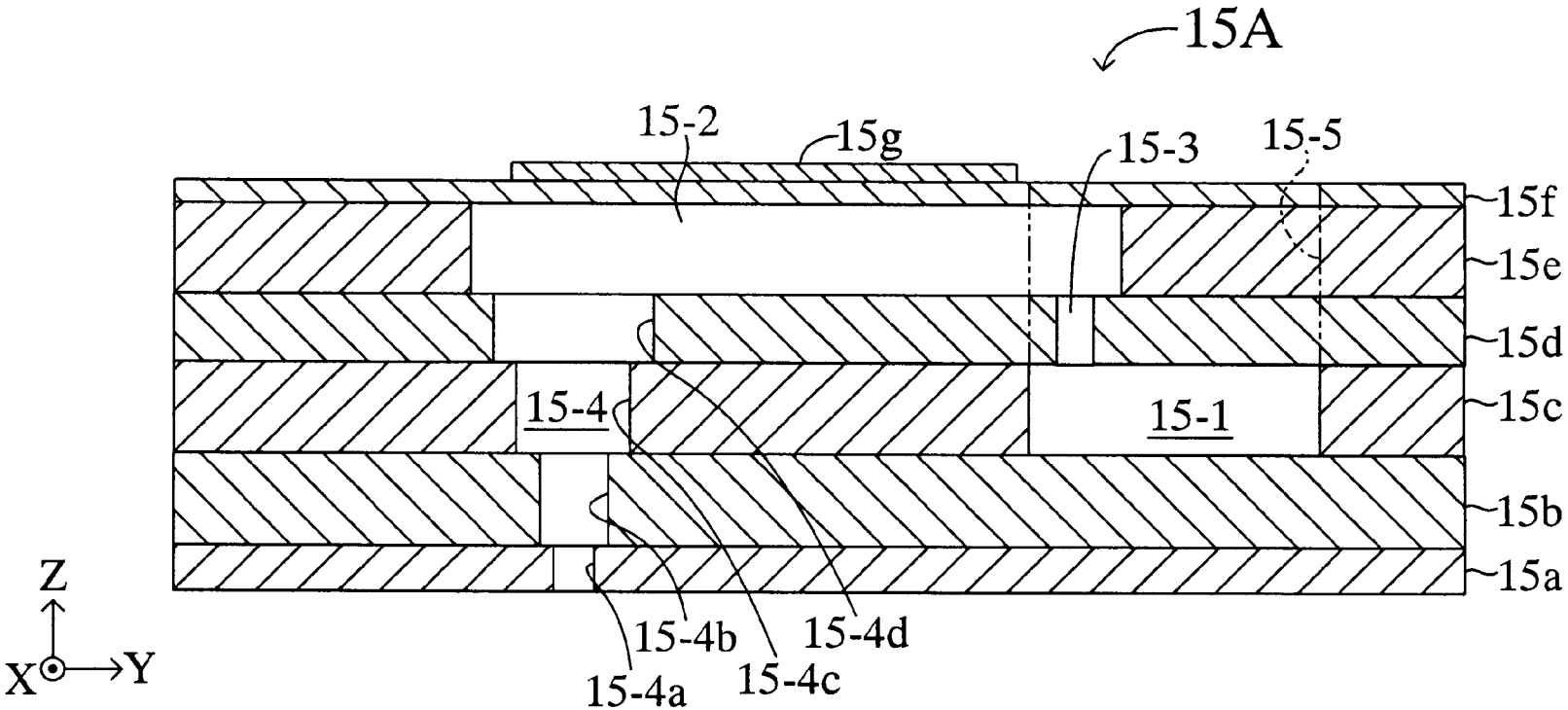
FIG. 4 is a sectional view of the injection device taken along line IV—IV of FIG. 3.

As shown in FIG. 3, a plan view showing the injection device 15A, and FIG. 4, a sectional view of the injection device 15A taken along line IV—IV of FIG. 3, the injection device 15A assumes the shape of a substantially rectangular parallelepiped whose sides are in parallel with mutually orthogonal X-, Y-, and Z-axes, and includes a plurality of thin ceramic members (hereinafter called "ceramic sheets") 15*a* to 15*f*, which are laminated under pressure, and a plurality of piezoelectric/electrostrictive elements 15*g* fixedly attached to the outer surface of the ceramic sheet 15*f* (an X-Y plane of the ceramic sheet 51*f* located on the positive side as viewed along the Z-axis). The injection device 15A includes internally a liquid feed path 15-1; a plurality of mutually independent chambers 15-2 (7 chambers per row, 14 chambers in total); a plurality of liquid introduction holes 15-3 for establishing communication between the chambers 15-2 and the liquid feed path 15-1; a plurality of liquid discharge nozzles 15-4, one end of each nozzle 15-4 being substantially exposed to the intake path 21 so as to establish communication between the chambers 15-2 and the exterior of the injection device 15A; and a liquid inlet 15-5.

The liquid feed path 15-1 is a space defined by the side wall surface of an oblong cutout which is formed in the ceramic sheet 15*c* and whose major and minor axes extend along the X- and Y-axis, respectively; the upper surface of the ceramic sheet 15*b*; and the lower surface of the ceramic sheet 15*d*.

Each of the chambers 15-2 is an elongated space (an elongated liquid flow path) defined by the side wall surface of an oblong cutout which is formed in the ceramic sheet 15*e* and whose major and minor axes extend along the X- and Y-axis, respectively; the upper surface of the ceramic sheet 15*d*; and the lower surface of the ceramic sheet 15*f*. Each of the chambers 15-2 extends along the Y-axis such that one end portion thereof is located above the liquid feed path 15-1, thereby communicating with the liquid feed path 15-1 via the cylindrical liquid introduction hole 15-3 having the diameter d and formed in the ceramic sheet 15*d* at the position corresponding to the one end portion. As described, the liquid feed path 15-1 is common to all of the chambers 15-2.

Each of the liquid discharge nozzles 15-4 includes a cylindrical through-hole (liquid injection port) 15-4*a*, which is formed in the ceramic sheet 15*a*, has the diameter D, and is substantially exposed to the intake path 21; and cylindrical communication holes 15-4*b* to 15-4*d*, which are formed in the ceramic sheets 15*b* to 15*d*, respectively, such that their size (diameter) increases from the hole 15-4*b* to the hole 15-4*d*. The liquid injection port 15-4*a* and the communication holes 15-4*b* to 15-4*d* are coaxially arranged along the Z-axis.

The liquid inlet 15-5 is a space defined by the side wall of a cylindrical through-hole which is formed in the ceramic sheets 15*d* to 15*f* at an end portion of the injection device 15A as viewed in the positive direction of the X-axis and at a central portion of the injection device 15A as viewed along the Y-axis, and is adapted to establish communication between the liquid feed path 15-1 and the exterior of the injection device 15A.

The piezoelectric/electrostrictive elements 15*g* are slightly smaller than the corresponding chambers 15-2 as viewed from above (as viewed from the positive direction of the Z-axis), and are fixedly attached to the upper surface of the ceramic sheet 15*f* while being disposed within the corresponding chambers 15-2 as viewed from above. Each of the piezoelectric/electrostrictive elements 15*g* is operated (actuated) on the basis of the drive voltage signal DV, which is issued (generated) by the drive voltage signal generation device (circuit) of the electric controller 30 and applied between electrodes disposed on the upper and lower surfaces of the piezoelectric/electrostrictive element 15*g*, thereby deforming the ceramic sheet 15*f* (the upper wall of the chamber 15-2) and thus changing the volume of the chamber 15-2 by $\Delta V$.

As shown in FIG. 2, the thus-configured injection device 15A is fixedly attached to the injection device fixation plate 15B. The injection device fixation plate 15B assumes a rectangular shape slightly greater than the injection device 15A. The injection device fixation plate 15B has unillustrated through-holes formed therein such that, when the injection device 15A is fixedly attached thereto, the through-holes face the corresponding liquid injection ports 15-4*a* of the injection device 15A, thereby exposing the liquid injection ports 15-4*a* to the exterior of the injection device 15A (i.e., to the intake path 21). The injection device fixation plate 15B is fixedly retained at its peripheral portion by means of the retaining unit 15C.

The retaining unit 15C assumes an external shape identical with that of the injection device fixation plate 15B. As shown in FIG. 1, the retaining unit 15C is fixedly attached to the intake port 20 of the internal combustion engine at its peripheral portion by use of unillustrated bolts. As shown in FIG. 2, a through-hole whose diameter is slightly greater than that of the external cylinder 14*c* of the discharge valve 14 is formed in the retaining unit 15C at a central portion thereof. The external cylinder 14*c* is inserted into the through-hole.

The inside diameter of the cylindrical sleeve 15D is equal to the outside diameter of the external cylinder 14*c* of the discharge valve 14. One end of the sleeve 15D is closed, and the other end is opened. An opening having a diameter equal to that of the liquid inlet 15-5 of the injection device 15A is formed in the closed end portion of the sleeve 15D at the center thereof. The sleeve 15D is press-fitted between the external cylinder 14*c* and the retaining unit 15C, thereby establishing communication between the discharge holes of the discharge valve 14 and the liquid inlet 15-5 via the opening formed in the closed end portion of the sleeve 15D.

In operation, when the valve-opening drive signal is issued (generated) to the discharge valve 14, the needle valve 14*d*, which is a solenoid-operated valve, opens the liquid path 14*b*. As a result, fuel is discharged from the discharge holes of the discharge valve 14 into the liquid feed path 15-1 via the liquid inlet 15-5, thereby being introduced into the chambers 15-2 via the corresponding liquid introduction holes 15-3. Vibration energy is applied to fuel contained in the chambers 15-2, whereby fuel is injected in the form of fine (atomized) liquid droplets into the intake path 21 of the intake port 20 via the liquid discharge nozzles 15-4 (liquid injection ports 15-4*a*) and the through-holes formed in the injection device fixation plate 15B.

As shown in FIG. 1, the electric controller 30 is connected to a reference angle sensor 31 for generating a pulse when a certain cylinder of an internal combustion engine is at the top dead center of an intake stroke, a crank angle sensor 32 for generating a pulse every time the internal combustion engine rotates by a predetermined crank angle, and an intake pipe pressure sensor 33 for detecting the internal pressure of the intake port 20. The electric controller 30 determines the required amount of fuel to be fed to the internal combustion engine on the basis of the engine speed N and the intake pipe pressure P obtained by means of these sensors. When the electric controller 30 detects, on the basis of the pulses output from the reference angle detection sensor 31 and the crank angle sensor 32, that a certain cylinder assumes a predetermined crank angle, the electric controller 30 sends the valve-opening drive signal INJ of high level (a valve-opening signal) to the discharge valve 14 of the cylinder for a time corresponding to the above-determined amount of fuel. Also, the electric controller 30 includes a drive voltage signal generation circuit for applying the drive voltage signal DV of frequency f (period T) between unillustrated electrodes of each piezoelectric/electrostrictive element 15*g*.

Next, the operation of the thus-configured liquid fuel injection system will be described with reference to FIGS. 5 and 6. The description below concerns fuel injection control to be conducted on the first cylinder. Fuel injection control is conducted similarly on other cylinders.

When the electric controller 30 detects from a pulse received from the reference angle sensor 31 and pulses received from the crank angle sensor 32 that the internal combustion engine has assumed a predetermined crank angle at which the intake valve 22 of the first cylinder is closed (e.g., a crank angle corresponding to near top dead center of a compression stroke), the electric controller 30 determines a time during which the valve-opening drive signal INJ of high level is output (i.e., fuel injection time), on the basis of engine operating conditions such as the engine speed N obtained from the number of pulses received from the crank angle sensor 32 within a predetermined time and the intake pipe pressure P detected by the intake pipe pressure sensor 33. Then, as shown in FIG. 5, at time t1, the electric controller 30 outputs the valve-opening drive signal INJ of high level to the discharge valve 14 of the first cylinder and begins to apply the drive voltage signal DV of frequency f between the electrodes of each piezoelectric/electrostrictive element 15*g*.

The above-mentioned predetermined crank angle is determined such that, even when the injection time is maximized, the valve-opening drive signal INJ of high level is terminated (i.e., the valve-opening drive signal INJ is brought to low level from high level to thereby end fuel injection) at a point of time when the crank angle coincides a predetermined crank angle which is in advance of a crank angle at which the intake valve 22 of the first cylinder is opened.

When the valve-opening drive signal INJ of high level is sent at time t1 to the discharge valve 14, the needle valve 14*d* is moved so as to open. Thus, liquid fuel contained in the liquid path 14*b* begins to be discharged into the liquid feed path 15-1 of the injection device 15A via the liquid inlet 15-5 of the injection device 15A. As a result, the pressure of liquid fuel contained in the liquid feed path 15-1 and the chambers 15-2 begins to increase. When the pressure exceeds a predetermined pressure, fuel is ejected (injected) from the liquid injection ports 15-4*a* into the intake path 21 of the intake port 20 with (while) being directed toward the back surface of the intake valve 22.

At this time, since the drive voltage signal DV of frequency f is applied to the piezoelectric/electrostrictive elements 15*g*, the volume of the chambers 15-2 fluctuates at frequency f. As a result, as shown in FIG. 6, since vibration energy induced by the operation of the piezoelectric/electrostrictive elements 15*g* (i.e., by fluctuations of the volume of the chambers 15-2) is applied to fuel contained in the chambers 15-2, constricted portions are formed on the fuel according to the period of vibration. Thus, the fuel leaves the liquid injection ports 15-4*a* while being torn off at the constricted portions. As a result, uniformly and finely atomized fuel is injected into the intake path 21.

Figure 5:
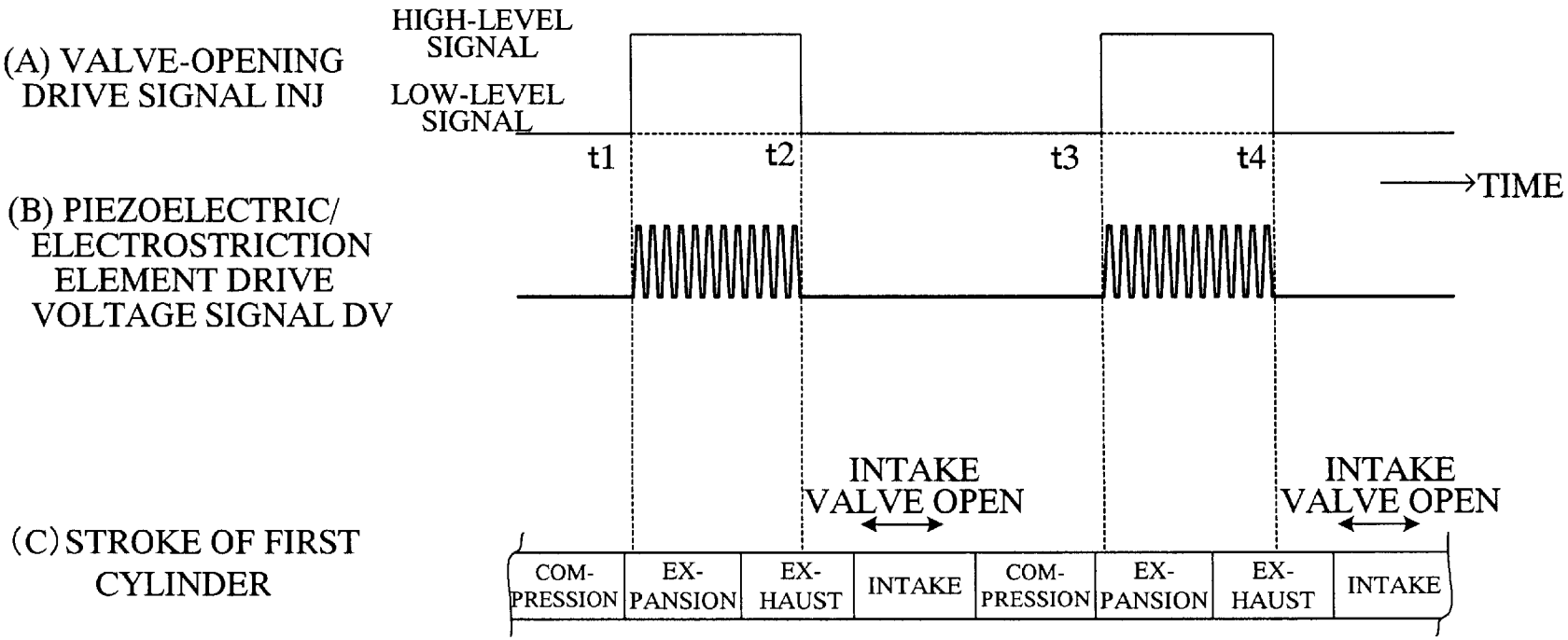
FIG. 5 is a timing chart showing a valve-opening drive signal to be issued (generated) to the discharge valve, a drive voltage signal to be applied to piezoelectric/electrostrictive elements, and the stroke of the first cylinder of the internal combustion engine of FIG. 1 accompanied by the timing of opening the intake valve.
Figure 6:
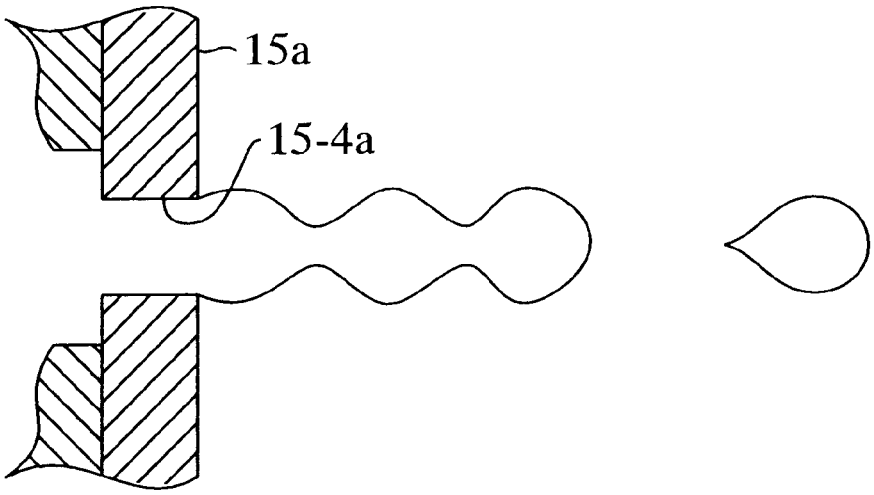
FIG. 6 is a view showing the state of liquid injected from the liquid fuel injection system of FIG. 1.

Subsequently, as shown in FIG. 5, at time t2, the electric controller 30 terminates the valve-opening drive signal INJ of high level (brings the valve-opening drive signal INJ to low level), thereby stopping fuel injection. At the same time, the electric controller 30 stops applying the drive voltage signal DV to the injection device 15A.

Then, the electric controller 30 again starts fuel injection in the manner described above. For example, when the internal combustion engine assumes the aforementioned predetermined crank angle; i.e., when time t3 in FIG. 5 is reached, the electric controller 30 issues (generates) the valve-opening drive signal INJ of high level to the discharge valve 14 and applies the drive voltage signal DV to the injection device 15A. Subsequently, when time t4 is reached after the elapse of the fuel injection time, the electric controller 30 terminates the high-level signal and the drive voltage signal DV.

As described above, according to the liquid fuel injection system of the present embodiment, fuel is pressurized by means of the pressure pump 11, whereby fuel under pressure is injected into the intake path 21 of the intake port 20; therefore, even when the internal pressure (boost pressure) of the intake path 21 fluctuates, a required amount of fuel can be stably injected.

Also, vibration energy is applied to fuel through variation of the volume of the chambers 15-2 of the injection device 15A, to atomize the fuel upon injection from the liquid discharge nozzles 15-4. Therefore, the liquid fuel injection system can inject highly fine liquid droplets of fuel. Further, since the injection device 15A includes a plurality of chambers 15-2, even when bubbles are generated within fuel, the bubbles tend to be finely divided, thereby avoiding great fluctuations in the amount of injection which would otherwise result from the presence of bubbles.

Further, in the present embodiment, the valve-opening drive signal INJ of high level is issued (generated) (i.e., fuel is injected) only during a period of time when the intake valve 22 of the internal combustion engine is closed. That is, the injection units inject fuel in the vicinity of the corresponding intake valves only during a period of time when the corresponding intake valves are closed. As a result, fuel injected by means of the liquid fuel injection system of the present embodiment becomes well (uniformly) misted premixture in the internal space of each intake path 21 where almost no air flow arises, or air flow is stable. Subsequently, the thus-prepared pre-mixture is taken into each cylinder at a stroke when the corresponding intake valve is opened.

Thus, there can be avoided a problem in that finely atomized liquid droplets of fuel collide due to turbulence within the intake path 21 and grow into larger liquid droplets, and the thus-grown liquid droplets adhere to a wall or surface which forms the intake path 21 (such as the wall of the intake port 20 or the back surface of the intake valve 22). Thus, the present embodiment can enhance fuel economy and reduce undesirable exhaust gas. Further, even when liquid droplets of injected fuel adhere to the intake path 21 and the periphery of the intake valve 22, the adhering liquid droplets readily evaporate, since they are very fine. Therefore, it can be avoided for the liquid fuel to drop into a cylinder when the intake valve 22 is opened. Thus, fuel economy of the internal combustion engine can be improved, and undesirable exhaust gas can be reduced.

The above-described advantageous effects of the present invention were confirmed through experiments.

In the above-described embodiment, the injection device includes a plurality of liquid discharge nozzles, a plurality of piezoelectric/electrostrictive elements, and a plurality of chambers. However, in some applications, the injection device may be fabricated to include a single liquid discharge nozzle, a single piezoelectric/electrostrictive element, and a single chamber.

Obviously, numerous modifications and variations of the present invention are possible in light of the above teachings. It is therefore to be understood that within the scope of the appended claims, the present invention may be practiced otherwise than as specifically described herein.

What is claimed is:

1. A liquid fuel injection system comprising:

an injection device including a liquid discharge nozzle having one end exposed to an intake path of an internal combustion engine, the intake path being equipped with an intake valve, a piezoelectric/electrostrictive element operated by means of a drive voltage signal, a chamber whose volume changes with operation of said piezoelectric/electrostrictive element and to which the other end of said liquid discharge nozzle is connected, a liquid feed path connected to said chamber, and a liquid inlet for establishing communication between said liquid feed path and an exterior of said injection device;

a drive voltage generation device for supplying said drive voltage signal to said piezoelectric/electrostrictive element;

a pressurizing unit for pressurizing liquid fuel;

a discharge valve including a liquid path, to which liquid fuel pressurized by means of said pressurizing unit is fed, and a solenoid-operated valve for opening and closing said liquid path in response to a valve-opening drive signal, said solenoid-operated valve being opened in response to receipt of said valve-opening drive signal in order to discharge liquid fuel, fed from said pressurizing unit, into said liquid inlet of said injection device via said liquid path; and a valve-opening drive signal generation device for supplying said valve-opening drive signal to said solenoid-operated valve;

liquid fuel, discharged from said discharge valve and injected into said intake path from said liquid discharge nozzle, being atomized by means of variation in volume of said chamber;

wherein said valve-opening drive signal generation device issues said valve-opening drive signal only during a period of time when said intake valve is closed.

2. A liquid fuel injection system according to claim 1, wherein said injection device is formed out of a plurality of thin ceramic sheets laminated under pressure and out of a plurality of piezoelectric/electrostrictive elements fixedly attached to the outer surface of one of said ceramic sheets.

3. A liquid fuel injection system according to claim 1, wherein said injection device includes a plurality of said liquid discharge nozzles and a plurality of said chambers connected to said liquid path common to said chambers.

4. A liquid fuel injection system according to claim 1, wherein said drive voltage signal supplied to said piezoelectric/electrostrictive elements is a signal of frequency f.

5. A liquid fuel injection system according to claim 1, wherein said injection device is configured in a manner as to inject fuel from said liquid discharge nozzle into the intake path toward the back surface of said intake valve.

* * * * *